US006889744B2

(12) United States Patent
Keetman et al.

(10) Patent No.: US 6,889,744 B2
(45) Date of Patent: May 10, 2005

(54) DEVICE AND METHOD FOR THE IN-SITU FOAMING OF HOLLOW PROFILES WITH METAL FOAM

(75) Inventors: Eric Keetman, Potsdam (DE); Karl-Heinz Suess, Lappersdorf (DE)

(73) Assignee: EADS Deutschland GmbH, Ottobrunn (DE)

( * ) Notice: Subject to any disclaimer, the term of this patent is extended or adjusted under 35 U.S.C. 154(b) by 0 days.

(21) Appl. No.: 10/319,826

(22) Filed: Dec. 16, 2002

(65) Prior Publication Data

US 2003/0131965 A1 Jul. 17, 2003

(30) Foreign Application Priority Data

Dec. 14, 2001 (DE) ..... 101 61 563

(51) Int. Cl.[7] ..... B22D 27/00; B22D 27/02
(52) U.S. Cl. ..... 164/79; 164/80; 75/415
(58) Field of Search ..... 75/415; 164/80, 164/79

(56) References Cited

U.S. PATENT DOCUMENTS 3,087,807 A 4/1963 Allen et al.
5,865,237 A 2/1999 Schoerghuber et al.
6,250,362 B1 * 6/2001 Rioja et al. ..... 164/46

FOREIGN PATENT DOCUMENTS

| | | |
|---|---|---|
| DE | 196 35 734 | 4/1997 |
| DE | 197 34 394 | 2/1998 |
| DE | 197 44 300 | 4/1998 |
| DE | 199 28 997 | 5/2001 |
| EP | 0 804 982 | 4/1997 |

* cited by examiner

*Primary Examiner*—Kuang Y. Lin
(74) *Attorney, Agent, or Firm*—Crowell & Moring LLP

(57) ABSTRACT

An apparatus and a method for foaming a hollow profile with metal foam are provided. The device comprises induction means, into which the hollow profile can be introduced, in which a foamable raw material is disposed, the hollow profile having an electrical interruption, which extends in its longitudinal direction of the hollow profile, and being in contact with the induction means at least at one place, so that, during the inductive foaming of the raw material, the hollow profile forms part of the induction means.

10 Claims, 1 Drawing Sheet

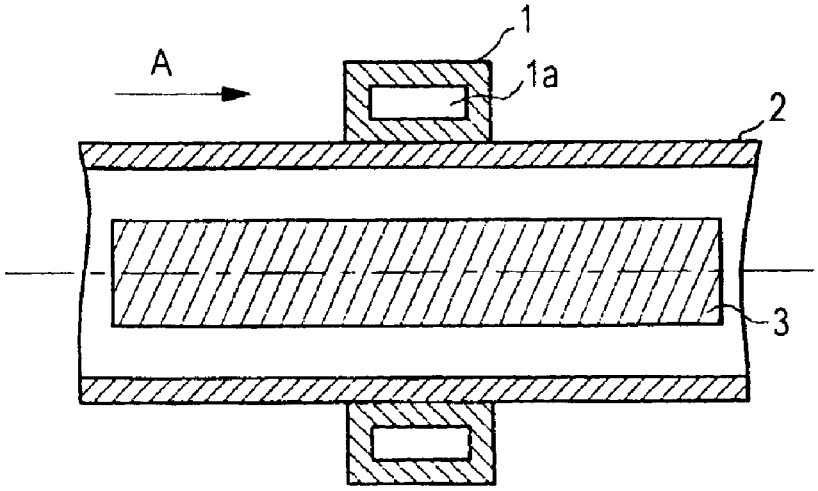
FIG.1
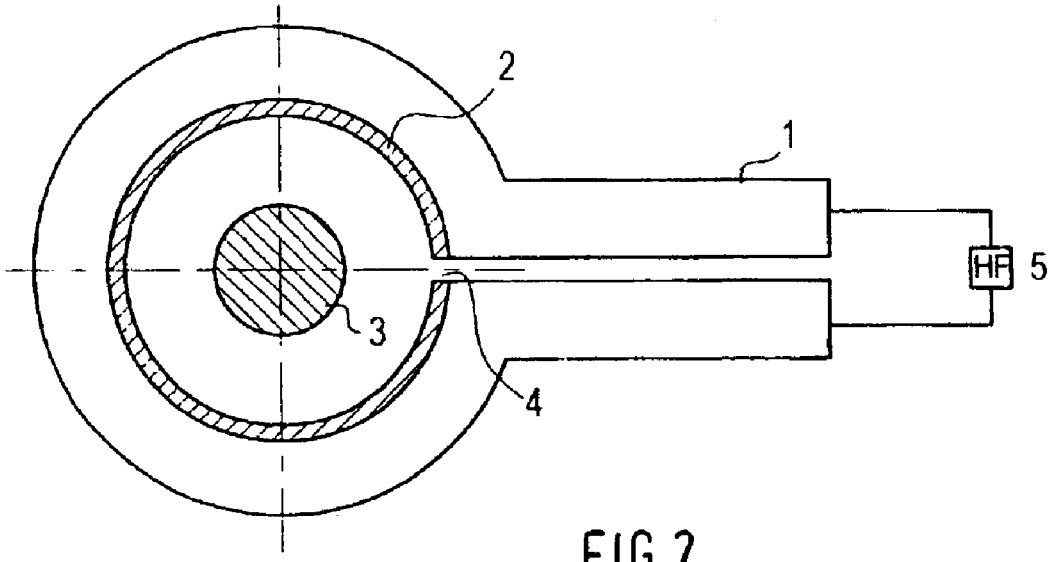
FIG.2
Fig. 3
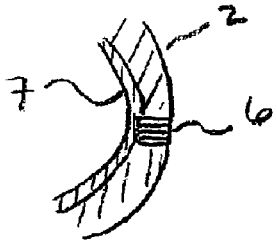

DEVICE AND METHOD FOR THE IN-SITU FOAMING OF HOLLOW PROFILES WITH METAL FOAM

BACKGROUND AND SUMMARY OF THE INVENTION

This application claims the priority of German Patent Document 101 61 563.9, filed on Dec. 14, 2001, the disclosure of which is expressly incorporated by reference herein.

The present invention relates to an apparatus, as well as to a method, for the in-situ foaming of hollow profiles with metal foam.

It is well known that profiles, foamed with metal foam, are potentially useful especially for lightweight applications in the automobile industry, as well as in aviation and space travel technologies. The metal foam increases the stiffness and functions as an insulating material and as a shock absorber, for example, in crash structures.

Different devices and methods, with which such foamed structures can be produced, are known. German Patent Document DE 197 44 300 A1 and European patent Document EP 0 804 982 A2, for example, describe arrangements, for which the foaming of the raw material is carried out in a prechamber. The metal foam, produced in the prechamber, has a flowable, flexible consistency and is introduced through suitable outlet openings into profiles, which are to be foamed, and is solidified there. Consequently, for such a method, the metal foam is produced at a place other than where it is finally required. A separate transporting step is therefore necessary. This requires much technical effort, since the formation of the foam and its introduction into the profile must be monitored and coordinated separately. Moreover, the foaming of profiles with a similar foam material (such as the foaming of aluminum profiles with aluminum foam) is very difficult, since the foam, because of the high thermal conductivity of the profile, which is to be foamed, cools very rapidly and solidifies when brought into the profile. This is associated with the disadvantage that profiles with undercuts must be heated before they are foamed. However, the temperature necessary for this lies within the range of flow temperatures of this foam and therefore has a negative effect on the profile properties.

Furthermore, a device and a method for producing metal foam, for which the foam is applied immediately as it is being formed, is described in German Patent Document DE 197 34 394 A1. For this purpose, the raw material, which can be foamed, is foamed in a so-called foam cell. The metal foam is produced directly at the place, where it is processed, under defined boundary conditions, for example, independently of the shape of the profile, which is to be foamed, and is introduced into the profile without any long transporting paths. In order to reach very inaccessible places in the interior of the profile, which is to be foamed, the foam cell can be mounted at the tip of a rod-like foaming lance. The foamable raw material is heated with the help of conventional sources of heat, such as gas burners, electrical resistance heating, induction coils, electron beam sources and laser sources. However, the problem of homogeneously foaming profiles having undercuts continues to exist, since the foam cools off as it flows. This problem occurs particularly if the profile is to be foamed with a similar foam material.

Furthermore, German Patent Document DE 199 28 997 C2 describes the foaming of raw material by irradiation with a laser or electron beam. For this, the heat introduced is concentrated on the raw material, which is to be foamed without significantly heating the profile surrounding the raw material. Damage to the hollow profile is avoided by these means. Furthermore, it is advantageous that the foaming process takes place where the foamed material is required, so that a flexible production of the metal foam, which is essentially independent of the shape, is ensured. It is, however, a disadvantage that essentially, the method is limited to cases, in which the profile material and the foam material are different. In the case of a combination of similar materials, such as an aluminum profile and an aluminum foam, there are problems because of the process temperature required, which is higher than the melting temperature of the foam material. Furthermore, when the raw material, which is to be foamed, is heated by means of a laser, it must be taken into consideration that there is visual contact with the raw material. If layers, lying on top of one another are foamed, this is possible only successively and the raw material must be supplied suitably, which usually is a problem technically.

Accordingly, it is an aspect of the present invention, to provide a device and a method for the in-situ foaming of hollow profiles with metal foam, which enables hollow profiles, optionally with undercuts, to be foamed partially, especially also when the hollow profile and the metal foam consist of similar materials. Moreover, the ease of using the apparatus and the method is improved.

Pursuant to certain preferred embodiments of the invention, this aspect can be accomplished by a device, which comprises induction means, into which a hollow profile can be introduced, in which a foamable raw material is disposed, the hollow profile having an electrical interruption, which extends in its longitudinal direction and being in contact with the induction means in at least one place, so that, during the inductive foaming of the raw material, the hollow profile forms part of the induction means.

An important aspect here is that the hollow profile itself, because it contacts the induction means, represents a part of the induction means. This is possible, owing to the fact that, furthermore, in the hollow profile, extending in the longitudinal direction of the latter, an electrical interruption is disposed, so that a short circuit of the induction means is effectively prevented. At the same time, this means that the electrical interruption extends in any manner over the whole longitudinal direction. Because of this configuration, the hollow profile becomes a "quasi inductor", which itself is heated up only slightly, when the raw material is inductively heated, and has a positive effect on the formation of the magnetic field.

This device has the advantage that the metal foam is produced directly at the place at which it finally is required. By this, a very effective foaming is ensured, since the metal foam does not have to be introduced or passed on. With that, the difficulties, associated with introducing the foam, no longer exist. Furthermore, it is advantageous that undercuts in the interior of a hollow profile can also be foamed reliably, because of the all-around heating of the raw material, a uniform expansion of the foaming raw material is achieved. At the same time, the foam density can be varied by way of the process parameters. The process parameters can, of course, also be varied during the foaming process, so that the hollow profile is filled with a gradient material. A further advantage consists therein that only a few components (induction means, hollow profiles and raw material) are required, so that a simple arrangement with low process costs is realized.

It is preferred to construct the induction means, so that it can be cooled. This is realized, for example, by cooling water circulating within the induction means. This has the advantage that the hollow profile, because of its contact with the induction means, is cooled at the same time, which is advantageous especially when the hollow profile is foamed with a similar foam material since, in this way, the temperature of the hollow profile is kept below the melting temperature of the raw material.

Advantageously, the shape of the induction means corresponds basically to the shape of the hollow profile. By this, uniform contacting over the whole periphery of the hollow profile is ensured, which brings about a uniform foaming and consequently has a positive effect on the foaming characteristics. Moreover, the magnetic field, required for the inductive heating of the raw material, is adapted optimally by this to the circumstances. At the same time, it is particularly advantageous to configure the induction means, so that its shape can be adapted, so that they adapt themselves automatically and flexibly to the shape of the hollow profile.

Furthermore, it is preferred that the hollow profile have a circular, oval, rectangular or any other cross-section. In this way, a flexible application is ensured.

It is particularly preferred to configure the electrical interruption as a slot. This ensures a reliable electrical interruption, in order to avoid a short circuit of the induction means. Moreover, it can easily be realized technicality.

According to an alternative embodiment, the electrical interruption is an electrically nonconductive material, which is incorporated in the wall of the hollow profile or in a slot disposed therein.

Furthermore, it is particularly advantageous that the induction means and the hollow profile are disposed, so that they can be shifted relative to one another. With that, not only a partial, but also a continuous foaming of hollow profiles is easily possible.

In addition, it is advantageous that the device can be used as a mobile device. This simplifies the use in mass production and makes on-site repairs possible.

An aspect of the invention furthermore is accomplished by a method, which is distinguished pursuant to certain preferred embodiments of the invention owing to the fact that a hollow profile, which is to be foamed, is introduced into induction means or surrounded by the induction means, so that the hollow profile contacts the induction means at least at one place, the hollow profile having an electrical interruption, which extends in the longitudinal direction of the hollow profile, a foamable raw material being disposed within the hollow profile and the raw material being foamed, the hollow profile forming part of the induction means.

Such a method has the advantage that the foaming process takes place where it is required. With that, the difficulties, which arise with the known methods while introducing the foamed metal into a hollow profile, do not occur. Moreover, the profiles may be foamed discontinuously, continuously or partially and undercuts or other asymmetries of the profile do not interfere with the foaming process. Because of the fact that the hollow profile forms part of the induction means and therefore is heated only slightly, if at all, the hollow profiles may be foamed with foam of a material, similar to that of the hollow profile. Accordingly, aluminum profiles, for example, can readily be foamed with aluminum foam.

It is advantageous that the electrical interruption be introduced into the hollow profile, before it is introduced into the induction means. Preferably, the electrical interruption is introduced by cutting open the hollow profile in its longitudinal direction, so that a slot is formed. This represents a particularly simple procedure. Such a slot can be made very narrow, so that the bending stiffness of the hollow profile is hardly or only marginally affected.

According to an alternative embodiment, the slot is filled with an insulating material. This is particularly advantageous if the outer contour of the hollow profile is to be maintained or if the hollow profile is to be provided with additional stability.

Advantageously, it is also possible to use a raw material, which consists of a mixture of different materials, so that the foamed metal foam has a composite structure.

Moreover, it is advantageous that the process parameters can be changed during the foaming of the raw material, so that the hollow profile is foamed with a metal foam, which has a gradient structure. Accordingly, foams with desired structures and properties can be produced easily.

It is furthermore advantageous to provide the inner wall of the hollow profile with an insulating layer before the foaming. This step of the methods is particularly appropriate if the hollow profile is to be foamed continuously, in order to prevent a short circuit over the electrical interruption because of the metal foam, which is spreading out in the hollow profile.

In the case of such a continuous foaming, it is of advantage to move the induction means as well as the hollow profile, which is disposed therein, relative to one another in the longitudinal direction. In this connection, it is possible to shift either the hollow profile within the induction means or the induction means with respect to a stationary hollow profile. With that, the method can be adapted to the existing circumstances.

Furthermore, in the case of some arrangements, it is appropriate to close the slot once again by welding after the hollow profile is foamed. This is a simple step, which can readily be integrated into existing procedures or arrangements.

It is particularly advantageous that the method can be used in a mobile manner. By this, the method can be integrated easily in existing production processes. For example, appropriately foamed components need no longer be supplied. This simplifies the production process and lowers production costs.

Another aspect of the invention is accomplished furthermore by a semi-finished product comprising a foamed hollow profile, which is produced by the apparatus or method.

Advisably, the semi-finished product is used for crash structures in vehicle technology as well as in aviation and space travel, especially for the weight-specific increase in the stiffness and crash resistance.

Other objects, advantages and novel features of the present invention will become apparent from the following detailed description of the invention when considered in conjunction with the accompanying drawings.

BRIEF DESCRIPTION OF THE DRAWINGS

FIG. 1 shows a sectional view in the longitudinal direction of the hollow profile, which is introduced in the induction means, FIG. 2 shows a cross-sectional view of the arrangement shown in FIG. 1, and FIG. 3 shows a cross-sectional view of a preferred embodiment.

DETAILED DESCRIPTION OF THE DRAWINGS

FIG. 1 shows a sectional view in the longitudinal direction (direction of arrow A) of a hollow profile 2, which is to be foamed and has been introduced into induction means 1. The induction means can be constructed as an inductance coil, an inductor, or the like, to name but a few examples. A foamable raw material 3, which consists of a known mixture of metal powders (such as aluminum, magnesium or zinc powder) and blowing agent powder and is prepared by compacting, is present in the interior of the hollow profile 2. Optionally, the compaction is followed by an extrusion process. In FIG. 1, the raw material 3 is present in rod form. However, a pellet or granular raw material can, also, be used. A pellet raw material is understood to comprise, for example, pressed, small spheres. Furthermore, a mixture of different raw materials can be used, which contains, for example small, aluminum-based spheres as well as small ceramic spheres. However, different raw materials can also be used, which are based on different aluminum alloys. The same is conceivable for raw materials, which are based on magnesium, zinc, etc., which can be combined in any convenient manner, also with a ceramic raw material. In the case of a rod-shaped raw material, different raw materials can be disposed in sectors, concentrically or in any other convenient manner. The use of such raw material mixtures leads to the production of composite foams.

The hollow profile 2 in FIG. 1 is tubular and consists of aluminum magnesium, steel or the like. In addition, however, hollow profiles of other shapes, which have, for example, an oval, a rectangular or other suitable cross-section, can also be used. In addition, the hollow profile 2 may have undercuts, which are not shown. The hollow profile is disposed within the induction means 1, touching the induction means 1, at least in one place.

In the preferred embodiment, shown in FIG. 1, the contact extends along the whole inner surface of the induction means 1, in order to bring about as homogeneous and uniform a foaming process as possible. Ideally, the shape of the induction means 1 is fitted to that of the hollow profile 2. For example, in the case of a tubular hollow profile 2, induction means 1 is used, which has a circular inner cross-section. If the hollow profile has a rectangular cross-section, correspondingly rectangular induction means is used. Alternatively, form-fitting induction means can be used, which comprises a plurality of individual, movable elements, which adapt automatically to the shape of the hollow profile. In addition, the induction means can be hinged so as to facilitate the handling while enclosing the hollow profile.

Moreover, the induction means 1 preferably is constructed so that they can be cooled. For this purpose, cooling ducts 1*a*, through which, for example, cooling water is passed, are disposed in the induction means 1. Such an arrangement of cooling ducts is also possible in the case of form-fitting or chain-like induction means. The cooling water, flowing through the induction means 1, at the same time cools the hollow profile 2. The tighter or better the contact between the hollow profile 2 and the induction means 1, the better the cooling.

Furthermore, for the operating mode of certain preferred embodiments of the present invention, an electrical interruption 4, extending basically along the longitudinal direction A, is provided in the hollow profile 2 (see FIG. 2). Because of the contact between the hollow profile 2 and the induction means 1, there is an electrically-conducting connection between these two components. Without an interruption 4, this electrically-conducting connection would cause the induction means 1 to short circuit. In the event of a short circuit, there would not be a magnetic field for heating the raw material.

The electrical interruption 4 is constructed as a slot in FIG. 2. Alternatively, the electrical interruption may also consist of a non-conducting material 6, which is integrated in the wall of the hollow profile 2, as shown in FIG. 3. A slot-shaped electric interruption 4 can, however, also be filled with a suitable insulating material, such as mica, in order to improve the strength properties. The slot is introduced preferably before the foaming and before the hollow profile 2 is disposed in the induction means 1 by cutting open the hollow profile 2 in the longitudinal direction A. The slot may be straight or inclined or have any other convenient shape (such as L-shaped, U-shaped, Z-shaped, etc.) in the wall of the hollow profile. Moreover, especially for light-weight components, profiles consisting of two or more components, which are disposed at a distance from one another, so that this step of the processing can optionally be omitted from the very start, have been used increasingly in recent times.

The induction means 1 is supplied with power by an HF source 5. In the operating state, a magnetic field is formed, as a result of which the raw material 3, disposed in the interior of the hollow profile 2, is heated and foamed. Because of the conducting contact between the induction means 1 and the hollow profile 2, the latter, as it were, becomes part of the induction means 1 and the magnetic field, formed because of the flow of current, points basically in the longitudinal direction A. At the same time, the concentration of the magnetic field is greatest in the center of the induction means 1, where the raw material 3 is disposed. In operation, the hollow profile 2 is hardly heated to temperatures of up to about 100° C., so that the properties of the profile are retained. Moreover, the slight heating of the hollow profile is, supported by the cooling action described above.

In this way, the hollow profile 2 is foamed partially and homogeneously, the metal foam being formed at the place, where it is actually required. There is no need for a further transporting step. Moreover, because of the symmetrical arrangement and the all-around heating of the raw material, the foaming of undercuts, which are disposed within the hollow profile, is also not a problem.

However, the hollow profile 2 can also be foamed continuously. For this purpose, the inner wall of the hollow profile 2 is coated with an insulating material 7, such as stove enamel, before the foaming. The insulating material prevents short circuiting over the electrical interruption 4, if the interior of the hollow profile is filled with metal foam and, at the same time, lies closely in contact with the inner wall of the hollow profile 2. If the hollow profile 2, lined with insulating material, is moved relative to the induction means 1 in the longitudinal direction A, a continuous foaming of the hollow profile 2 is possible. In this connection it is immaterial whether the induction means 1 is moved with respect to the hollow profile 2 or vice versa. Independently of this, the metal foam is produced once again where it is required.

In a subsequent step of the process, the hollow profile 2, filled with foam and provided with a slot-shaped electrical interruption 4, is closed off once again by welding.

Furthermore, because of its simple configuration, the invention can be used mobily (portably), especially in automated production. Moreover, semi-finished, foamed, hollow profile products, which can be used as crash structures in vehicle technology, as well as in aviation and space travel technology, can be produced with the invention described above.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of using a device for in-situ foaming of a raw material disposed within a hollow profile comprising:

providing a device having induction means;

disposing a foamable raw material in a hollow profile, the hollow profile having an electrical interruption that extends in a longitudinal direction of the hollow profile;

introducing the hollow profile into the device, the hollow profile contacting the induction means in at least one place, so that the hollow profile forms part of the induction means; and foaming the raw material by inductive foaming.

2. The method according to claim 1, wherein the electrical interruption is introduced into the hollow profile, before the hollow profile is introduced into the induction means.

3. The method according to claim 1, wherein the electrical interruption is introduced by cutting open the hollow profile in the longitudinal direction of the hollow profile, so that a slot is formed.

4. The method according to claim 2, wherein the electrical interruption is introduced by cutting open the hollow profile in the longitudinal direction of the hollow profile, so that a slot is formed.

5. The method according to claim 3, wherein the slat is filled with an insulating material.

6. The method according to claim 1, wherein the induction means and the hollow profile disposed therein are moved relative to one another in the longitudinal direction, in order to foam the raw material continuously.

7. The method according to claim 3, wherein the slot is closed off by welding after the hollow profile is foamed.

8. The method according to claim 1, wherein the method can be used portably.

9. The method of claim 1 further comprising providing an inner wall of the hollow profile with an insulating layer before said foaming.

10. A method for in-situ foaming of a raw material disposed within a hollow profile, comprising:

introducing a hollow profile into induction means or surrounding the hollow profile by the induction means, so that the hollow profile touches the induction means at least at one place, the hollow profile having an electrical interruption extending in a longitudinal direction of the hollow profile;

disposing a raw material, which can be foamed, within the hollow profile; and foaming the raw material inductively, the hollow profile forming part of the induction means, wherein the method further comprises providing an inner wall of the hollow profile with an insulating layer before said foaming.

* * * * *